US010113425B2

(12) United States Patent
MacDonald et al.

(10) Patent No.: US 10,113,425 B2
(45) Date of Patent: Oct. 30, 2018

(54) UNDERGROUND MINING SYSTEM FOR REDUCED COSTS, IMPROVED EFFICIENCIES, HIGHER PRODUCTIVITY AND A SAFER WORKING ENVIRONMENT THROUGH PENETRATED BLOCK EXTRACTION

(71) Applicant: Underground Extraction Technologies Pty Ltd, Brisbane, Queensland (AU)

(72) Inventors: Brian MacDonald, Brisbane (AU); Michael Mapp, Brisbane (AU)

(73) Assignee: Underground Extraction Technologies Pty Ltd, Brisbane (AU)

( * ) Notice: Subject to any disclaimer, the term of this patent is extended or adjusted under 35 U.S.C. 154(b) by 0 days.

(21) Appl. No.: 15/513,300

(22) PCT Filed: Sep. 9, 2015

(86) PCT No.: PCT/AU2015/050531

§ 371 (c)(1),
(2) Date: Mar. 22, 2017

(87) PCT Pub. No.: WO2016/044886

PCT Pub. Date: Mar. 31, 2016

(65) Prior Publication Data

US 2017/0248017 A1 Aug. 31, 2017

(30) Foreign Application Priority Data

Sep. 23, 2014 (AU) ..... 2014903793
Jan. 15, 2015 (AU) ..... 2015900100

(51) Int. Cl.
*E21C 41/18* (2006.01)
*E21C 41/16* (2006.01)
(Continued)

(52) U.S. Cl.
CPC ..... *E21C 41/18* (2013.01); *E21B 7/046* (2013.01); *E21C 41/16* (2013.01); *E21D 15/00* (2013.01); *E21F 7/00* (2013.01)

(58) Field of Classification Search
CPC ..... E21C 27/24; E21C 41/16; E21C 35/24; E21C 41/18; E21F 13/02; E21F 7/00; E21B 7/046; E21D 15/00
(Continued)

(56) References Cited

U.S. PATENT DOCUMENTS 3,402,968 A 9/1968 Fischer
4,198,097 A 4/1980 Fondriest
(Continued)

FOREIGN PATENT DOCUMENTS

CN 102587914 A 7/2012
CN 102808622 A 12/2012
(Continued)

OTHER PUBLICATIONS

Donova, J., The Effects of Backfilling on Ground Control and Recovery in Thin-Seam Coal Mining, 1999, all pages (Year: 1999).*
(Continued)

*Primary Examiner* — Carib A Oquendo
(74) *Attorney, Agent, or Firm* — Brooks Kushman P.C.

(57) ABSTRACT

The present invention relates to a mining method including the step of forming one or more sets of gate roads. Each set of gate roads includes at least two headings typically for providing and retuning ventilation. Dead end plunge cuts extend from the sets of gate roads. Each plunge cut is formed with a continuous miner coupled to a flexible conveyor system. Each plunge cut is greater than 30 meters in length. Advantageously, narrow elongate pillars may be left between adjacent plunge cuts, thereby resulting in greater
(Continued)

material removal per volume and improved operating costs when compared with bord and pillar mining.

20 Claims, 9 Drawing Sheets

(51) Int. Cl.
*E21B 7/04* (2006.01)
*E21D 15/00* (2006.01)
*E21F 7/00* (2006.01)

(58) Field of Classification Search
USPC ..... 299/1.4, 1.6, 11, 12, 15, 18, 19, 30, 42
See application file for complete search history.

(56) References Cited

U.S. PATENT DOCUMENTS

| | | | |
|---|---|---|---|
| 4,312,540 | A | 1/1982 | Thompson et al. |
| 5,161,857 | A | 11/1992 | Mayercheck et al. |
| 5,646,845 | A | 7/1997 | Gudat et al. |
| 5,709,433 | A | 1/1998 | Christopher et al. |
| 5,871,260 | A | 2/1999 | Delli-Gatti, Jr. |
| 5,997,100 | A | 12/1999 | Marshall et al. |
| 2004/0207247 | A1 | 10/2004 | Jackson et al. |
| 2007/0170771 | A1 | 7/2007 | Cavinder et al. |
| 2007/0216216 | A1 | 9/2007 | Baird, Jr. et al. |
| 2012/0253584 | A1 | 10/2012 | Herdle |
| 2013/0248328 | A1 | 9/2013 | Lasley |

FOREIGN PATENT DOCUMENTS

| | | | |
|---|---|---|---|
| CN | 103498672 | A | 1/2014 |
| GB | 231132 | | 1/1925 |
| GB | 2229747 | A | 3/1990 |
| WO | 2001/007976 | A1 | 2/2001 |
| WO | 2001/86337 | A2 | 11/2001 |
| WO | 2007/148251 | A1 | 12/2007 |

OTHER PUBLICATIONS

Australian examination report dated Jul. 23, 2018 in connection with Australian Patent Appl. No. 2017202727.

Chinese Office Action dated Jul. 19, 2018 issued in connection with Chinese Patent Appl. No. 201580057579.8.

Australian Innovation Patent Examination Report No. 1 dated Mar. 19, 2015 issued in connection with Australian Patent Application No. 2015100039.

Australian Innovation Patent Examination Report No. 2 dated May 15, 2015 issued in connection with Australian Patent Application No. 2015100039.

Australian Innovation Patent Examination Report No. 3 dated Jul. 6, 2015 issued in connection with Australian Patent Application No. 2015100039.

Australian Patent Examination Report No. 1 dated Oct. 28, 2016 issued in connection with Australian Patent Application No. 2016210621.

PCT Written Opinion dated May 12, 2014 issued in connection with PCT Application No. PCT/AU2014/000355.

IPRP dated Mar. 22, 2016 issued in connection with PCT Application No. PCT/AU2015/050531.

ISR dated Oct. 13, 2015 issued in with PCT Appliatton No. PCT/AU2015/050531.

V. Istomin, et al., "Operating a continuous hauling system at United Colliery"; Univ. of Wollongong Research Online; 1998; pp. 300-312.

* cited by examiner

UNDERGROUND MINING SYSTEM FOR REDUCED COSTS, IMPROVED EFFICIENCIES, HIGHER PRODUCTIVITY AND A SAFER WORKING ENVIRONMENT THROUGH PENETRATED BLOCK EXTRACTION

TECHNICAL FIELD

The present invention generally relates to an underground mining system. The present invention has particular, although not exclusive application to coal and potash mining.

BACKGROUND

The reference to any prior art in this specification is not, and should not be taken as an acknowledgement or any form of suggestion that the prior art forms part of the common general knowledge.

Coal mining is performed to extract coal, lying in seams, from the ground. Many techniques have been employed to extract coal seams over the years, varying from tunneling though to large open cut mines. Two contemporary underground coal mining techniques include long wall mining, and bord and pillar mining as described below.

Long wall mining is a form of underground mining where a block of coal is mined using a moving long wall. A number of hydraulic jacks, called chocks, are placed in a long line in order to support the overlying strata (ie. the roof) at the coalface. The coal is then cut from the coalface by a machine called a shearer which travels back and forth along the long wall face in advance of the chocks, which move consecutively ahead to fill in the roof void created by the shearer as it completes its coal cutting pass.

Although the capital expense in setting up a long wall mine is very high, the operating cost is generally quite low. However, the long wall movement can be stifled in the event of an interrupted coal seam along a fault line which can undesirably greatly add to the operating cost and cause production disruptions. In addition, whilst mining personnel are generally working under fully supported roof (or chocks) most of the time, they are nevertheless required to work in close proximity to large and hazardous moving hydraulic and electrical equipment, near to the coal cutting face generally also in high airflow ventilation areas, and are as a result exposed to a variety of mining and environmental hazards.

Bord and pillar mining is initially less capital intensive than long wall mining. The coal seam is divided into a regular block like array by driving through tunnels termed "bords". The blocks of coal bounded by the bords are the "pillars". The pillars support the overlying strata during the "first workings" as the bords are created, and may be partially extracted systematically during the "second workings" upon retreat from the mine. Owing to the fact that the bord and pillar mining process is more labour intensive and has lower productivity than in longwall mining, in addition to the fact that not all of the coal is extracted, the overall operating costs of bord and pillar mining are substantially higher than long wall mining. In addition, mining personnel are required to work in confined spaces, in close proximity to large hazardous moving equipment, in areas where they may be inadequate roof or coal rib support and possibly with poor ventilation in blind tunnels. As a result they are exposed to a greater level of mining and environmental hazards than that of long wall mining.

The preferred embodiment provides an alternative mining method with lower initial capital costs than long wall mining, yet with improved productivity, a higher level of coal extraction and substantially reduced operating costs when compared with bord and pillar mining. Importantly also, mining personnel are generally remote from the mining process at the coal cutting face and are not exposed to the same level of mining or environmental hazards as those in either long wall or bord and pillar operations.

SUMMARY OF THE INVENTION

According to a first aspect of the present invention, there is provided a mine including:

- one or more sets of gate roads, each set of gate roads including at least two headings; and
- dead end plunge cuts extending from the sets of gate roads, each plunge cut having a generally quadrilateral cross section and being greater than 30 meters in length.

Advantageously, narrow elongate pillars may be left between adjacent plunge cuts, thereby resulting in greater material removal per volume and improved operating costs when compared with bord and pillar mining.

Preferably, in each set of gate roads, one of the at least two headings can supply air whereas another of the at least two headings can return air. Each set of gate roads may further include one or more cut-through tunnels ("cut-throughs") extending between adjacent headings providing inter connectivity between adjacent headings for logistics and ventilation purposes.

Preferably, the mine includes a set of main entry tunnels (also termed "main gates" or simply "mains") from which the sets of gate roads extend.

The mine may further include blocks of valuable material between adjacent sets of gate roads and into which the plunge cuts are formed. The mine may further include a supporting pillar between plunge cuts extending from adjacent sets of gate roads.

The plunge cuts may be parallel and extend obliquely from the sets of gate roads.

According to a second aspect of the present invention, there is provided a mining system including:

- the mine; and
- a continuous miner coupled to a flexible conveyor system for forming the plunge cuts.

Advantageously, the continuous miner and flexible conveyor system represent significantly lower initial capital and equipment costs than long wall mining. Further, the continuous miner is more adaptable in following an interrupted coal seam along or through a fault line or other discontinuity.

The continuous miner may include an inertial navigation system for navigating during formation of the plunge cuts. The inertial navigation system may include sensors for sensing characteristics including angle (e.g. horizon control), heading (e.g. positioning) and a system of determining the distance from the adjacent previously mined plunge cut. The continuous miner may include a gamma detection device for detecting characteristics (e.g. boundary) relating to the mined material. The continuous miner may include an inert gas supply for supplying inert gas to the cutting face of each plunge cut to avoid hazards such as frictional ignition, methane ignition as it is emitted from the coal or coal dust ignition in extreme events.

The system may include at least one ventilation barrier for at least partially blocking an entrance to each dead end plunge cut during its formation, yet permitting entry of the continuous miner coupled to the flexible conveyor system. The system may include sensors for sensing characteristics of the working environment in the blocked plunge cut during its formation. The characteristics may include the gas, ventilation, strata movement or dust levels in the plunge cut.

The system may include an operating centre (ROC) for remotely operating the continuous miner. As no mining personnel are present in the plunge cuts, the roof of each plunge cut need not be reinforced resulting in reduced costs and time, and substantially improved safety outcomes. The ROC may wirelessly communicate with the continuous miner over the Ethernet.

The system may further include a static conveyor (or a system of conveyors) for conveying material received from the flexible conveyor system to the surface of the mine.

According to a third aspect of the present invention, there is provided a mining method including the steps of forming:

one or more sets of gate roads, each set of gate roads including at least two headings; and dead end plunge cuts extending from the sets of gate roads, each plunge cut formed with a continuous miner coupled to a flexible conveyor system and being greater than 30 meters in length.

The method may involve forming a main entry tunnels ("mains") from which the sets of gate roads later extend. The method may involve extracting valuable material from the plunge cuts extending into one or more blocks of valuable material between adjacent sets of gate roads. The method may involve forming a supporting pillar between plunge cuts extending from adjacent sets of gate roads.

The continuous miner coupled to a flexible conveyor system may be unmanned. Accordingly, the roof of each plunge cut need never be reinforced. The plunge cuts may be of a depth to receive the continuous miner and, at least in part, the flexible conveyor system. The plunge cuts may receive most of the flexible conveyor system. The plunge cuts may be: greater than 100 m in length, greater than 200 m in length, greater than 300 m in length, greater than 400 m in length, or greater than 500 m in length. The plunge cuts may be between 30 m and 550 m deep. Accordingly, adjacent sets of gate roads could be up to 800 m or more apart, a substantially greater separation between gate roads than in long wall mining, which further reduces the mining costs.

The method may involve sealing each dead end plunge cut during its formation. The method may involve supplying inert gas (e.g. carbon dioxide or nitrogen) in each sealed plunge cut to avoid hazards such as frictional ignition, methane ignition as it is emitted from the coal or coal dust ignition in extreme events.

The method may involve remote monitoring of the working environment in the sealed plunge cut during its formation. The monitoring may involve monitoring the miner characteristics of the continuous miner. The miner characteristics may include angle (e.g. horizon control) and positioning (e.g. heading). The monitoring may involve monitoring the gas, ventilation, strata movement, dust levels in the plunge cut, and the distance from the adjacent previously mined plunge cut.

The method may involve forming the plunge cuts on one side of a set of gate roads prior to forming plunge cuts on another side of the set of gate roads.

The method may involve the introduction of a suitable fill material (such as a cementitous type fill or similar variant, with properties such that the fill "sets" to form a moderately strong homogenous material) into the mined out plunge cuts. Once the fill material sets, the continuous miner can then proceed to develop new plunge cuts within the valuable material that was previously not mined between adjacent plunge cuts. Accordingly almost all of the valuable material between each set of gate roads can be extracted by this mining process, save for the central main pillar left in the centre of the blocks of valuable material between plunge cuts extending from opposing gate roads. This results in a much greater level of coal extraction than that of bord and pillar mining.

According to a fourth aspect of the present invention, there is provided a mining method including the step of forming:

a series of dead end plunge cuts with a continuous miner coupled to a flexible conveyor system, the plunge cuts being greater than 30 meters in length.

The method may involve receiving the continuous miner and, at least in part, the flexible conveyor system during forming of the plunge cut. The method may involve sealing the dead end plunge cut whilst the dead end plunge cut is being formed. The method may involve supplying inert gas in each sealed plunge cut to avoid hazards such as frictional ignition, methane ignition as it is emitted from the coal or coal dust ignition in extreme events. The inert gas may be supplied at the cutting face. The method may involve remotely operating the continuous miner.

According to a fifth aspect of the present invention, there is provided method of mining underground and open-cut coal seams, including the steps of:

a. providing a continuous miner, a continuous haulage system, and a conveyor, the continuous haulage system being positioned between the continuous miner and the conveyor so as to convey coal from the continuous miner to the conveyor while the continuous miner is cutting, the continuous miner being capable of moving into a coal seam;

b. positioning the continuous miner with operatively joined continuous haulage system in a retracted state substantially adjacent an exposed face of the coal seam, wherein the continuous haulage system is operatively associated with the conveyor;

c. extending the continuous miner and continuous haulage system into the coal seam at an angle of about 20 to 170° to the coal face for a distance roughly equal to the length of the continuous miner and at least half of the continuous haulage system to form a plunge;

d. retracting the continuous miner and continuous haulage system from the plunge; and e. repeating steps (c) and (d) at least once after the practice thereof to form one or more additional plunges, each plunge being separated from an adjacent plunge by a pillar of coal.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
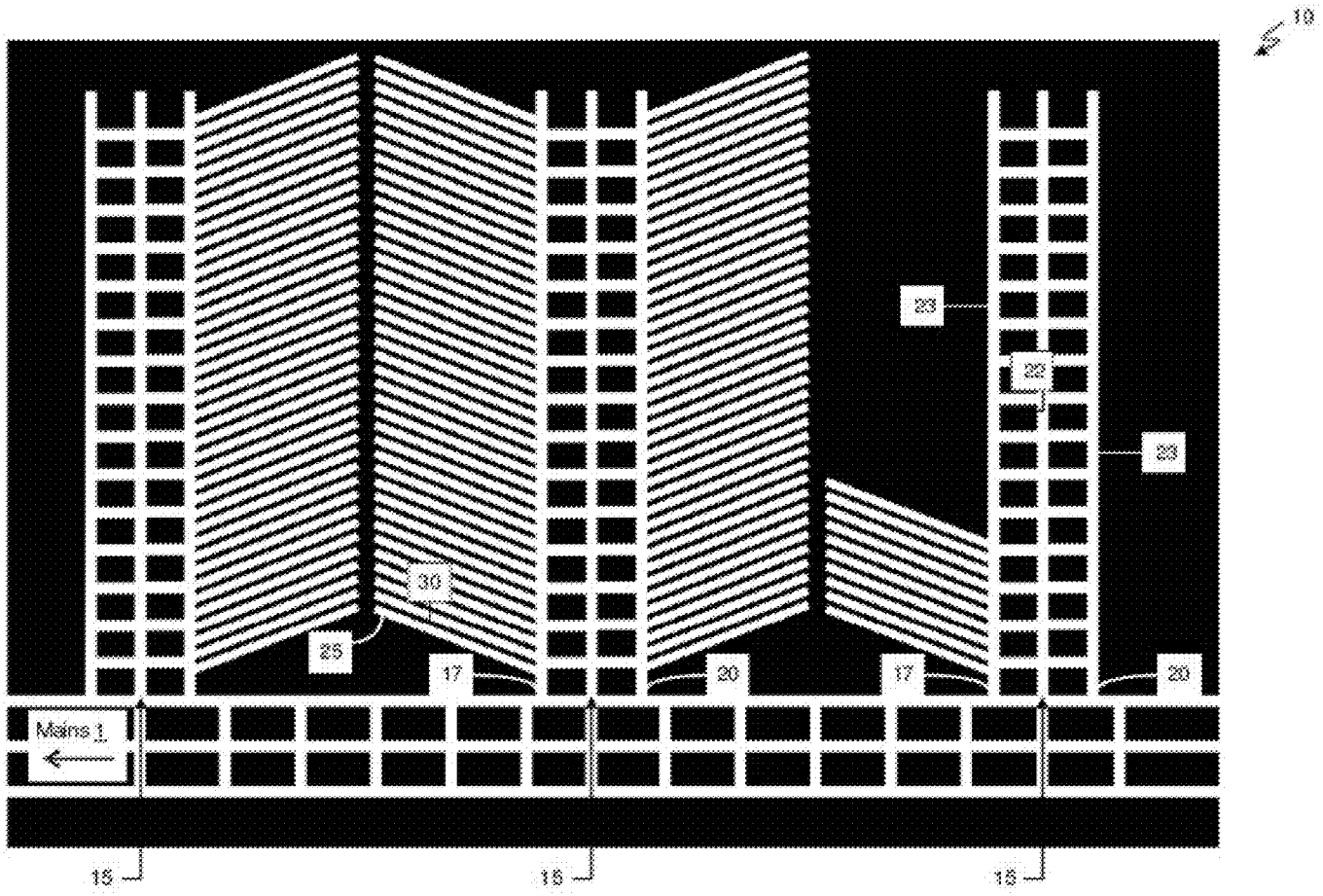
FIG. 1 is a plan sectional view of a underground coal mine in accordance with an embodiment of the present invention.

According to an embodiment of the present invention, there is provided an underground coal mine 10 as shown in FIG. 1. Tunnels are formed in a coal seam of the mine 10. Elaborating further, the mine 10 includes a triplet of main headings 1, and a triplet of spaced apart sets 15 of gate roads 17, 20 extending perpendicularly from the main headings 1 (also termed "main gates" or simply "mains"). Each set 15 of gate roads includes a triplet of gate roads or separated headings 17, 20. The mine 10 further includes cut-throughs extending between adjacent gate roads 17, 20 to form rectangular support pillars 22.

The mine 10 further includes two blocks of coal (i.e. valuable material) between adjacent sets 15 of gate roads 17, 20. Parallel dead-end plunge cuts 25 are formed in the coal blocks and extending obliquely from the sets 15 of gate roads 17, 20. Advantageously, narrow elongate coal pillars 30 are also left between adjacent plunge cuts 25, thereby resulting in greater material removal per volume and improved operating costs when compared with bord and pillar mining. The pillars 30 also provide adequate roof support so that additional roof bracing is not required in the plunge cuts. A central main pillar is also formed between opposed plunge cuts 25 from adjacent sets 15.

Figure 2:
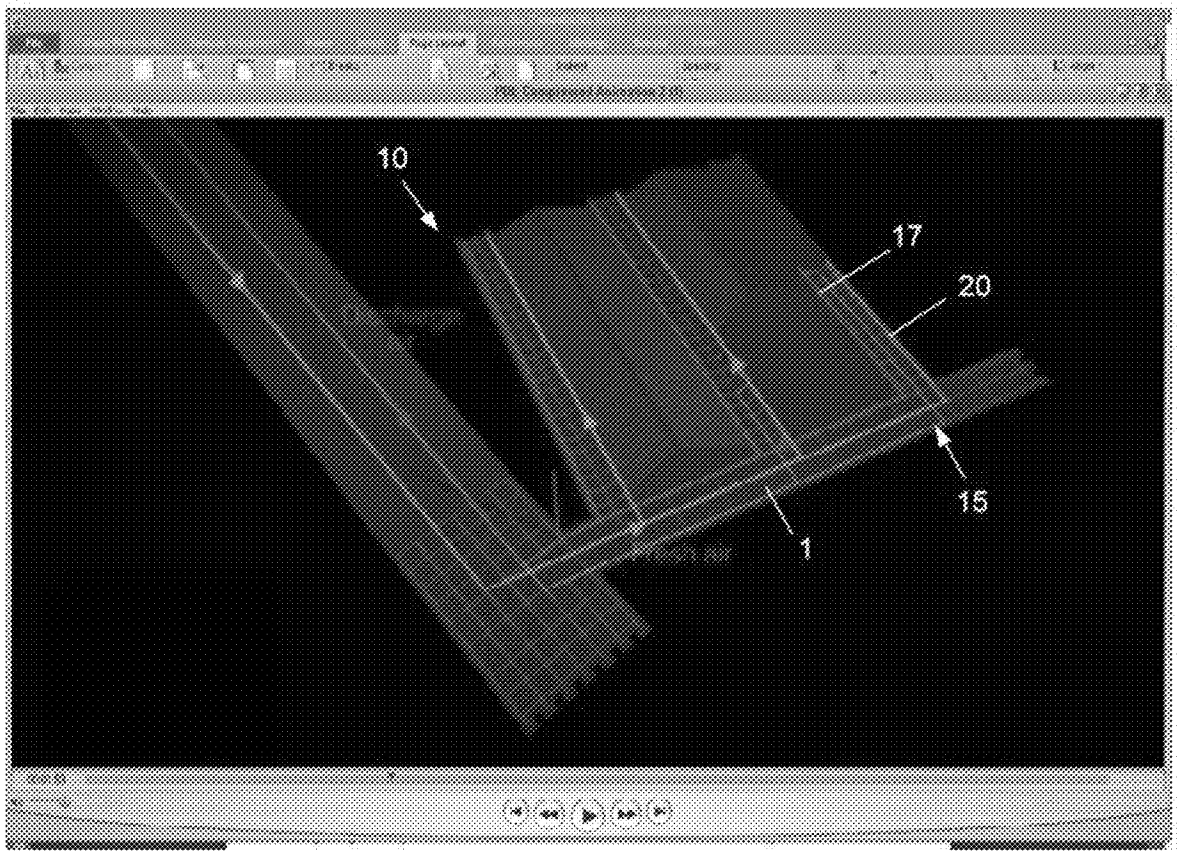
FIG. 2 is a perspective sectional view of the coal mine of FIG. 1 showing the ventilation.

Turning to FIG. 2, an outer gate road 20 of each set 15 can supply fresh air whereas the other outer gate road 17 returns discharge air. Appropriate ventilation control devices can be positioned within the tunnels to control air flow.

Figure 3:
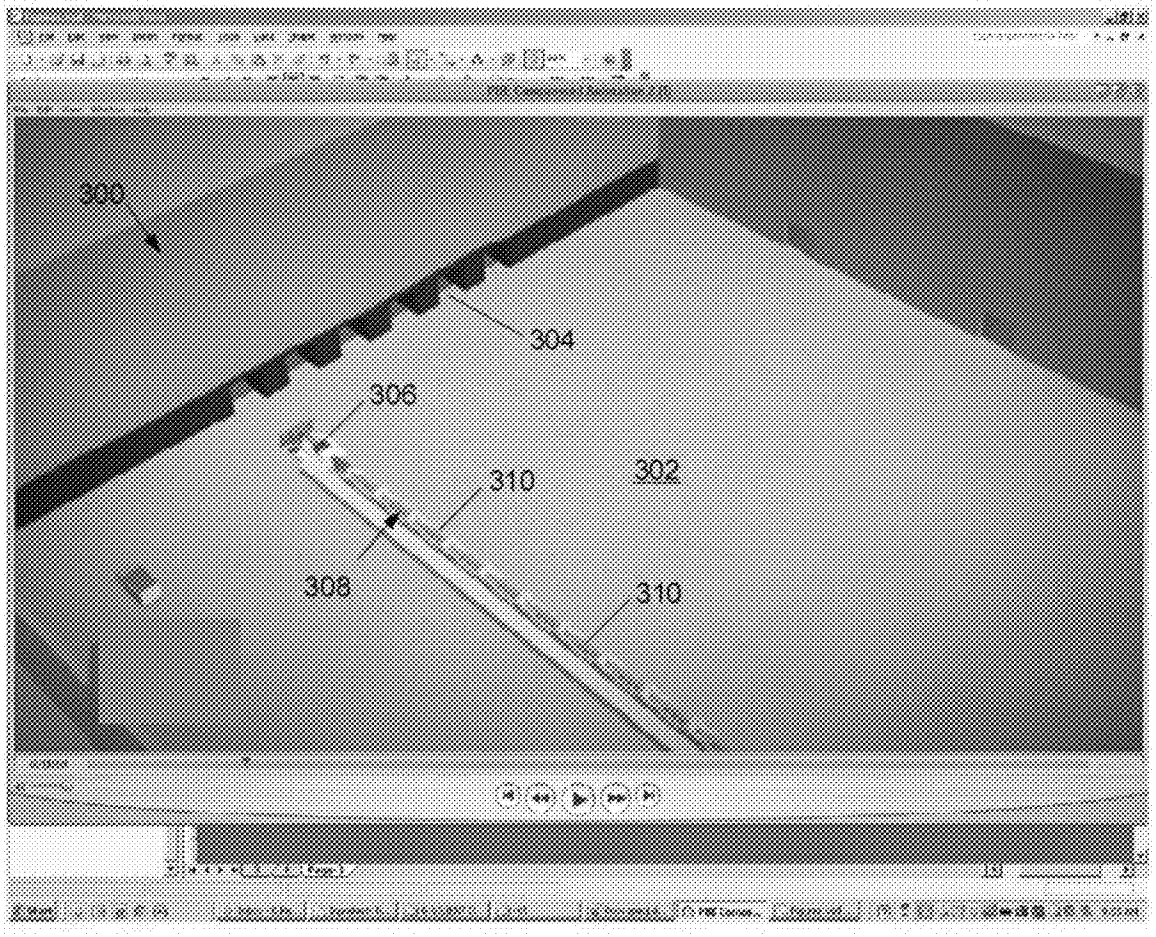
FIG. 3 is a perspective view of an open cut mine with the mining equipment in the base of an open pit near the entrance to the mine of FIG. 1, illustrating a continuous miner coupled to a flexible conveyor system.

Turning to FIG. 3, in this example, the mine 10 forms part of an open cut pit bottom mine entry system 300. The system 300 includes an open cut pit 302 with entry tunnels 304 to the mine 10. The system 300 further includes a continuous miner 306 coupled to a flexible conveyor system 308 (or continuous haulage system) for forming the generally rectangular (i.e. quadrilateral) plunge cuts 25. Advantageously, the continuous miner 306 and flexible conveyor system 308 represent significantly lower initial capital costs than long wall mining. Further, the continuous miner 306 is more adaptable in following an interrupted coal seam along or through a fault line or other discontinuity.

The continuous miner 306 cuts into the face 23 of the coal seam block, and passes the cut coal from the front of the miner 306 to the rear where it is automatically unloaded onto the flexible conveyor system 308. The continuous miner 306 is a machine that cuts coal from an exposed face of a coal seam, eliminating separate cutting, drilling, blasting, and loading operations otherwise called for in other coal mining processes. Generally, a continuous miner 306 will have a rotating cutter head that moves up and down and cuts coal from the exposed face of the coal seam as the cutter head rotates.

The flexible conveyor system 308 receives coal from the continuous miner 306. The flexible conveyor system 308 is a type of continuous haulage system of variable length, and includes a series of mobile conveyors 310 which can be coupled or decoupled to accommodate the length of the plunge cuts 25 to be made into the coal seam. That is, the length of the flexible conveyor system 308 can be varied (i.e., shortened or lengthened) as needed, depending on how far into the coal seam the continuous miner 306 will penetrate.

Figure 4:
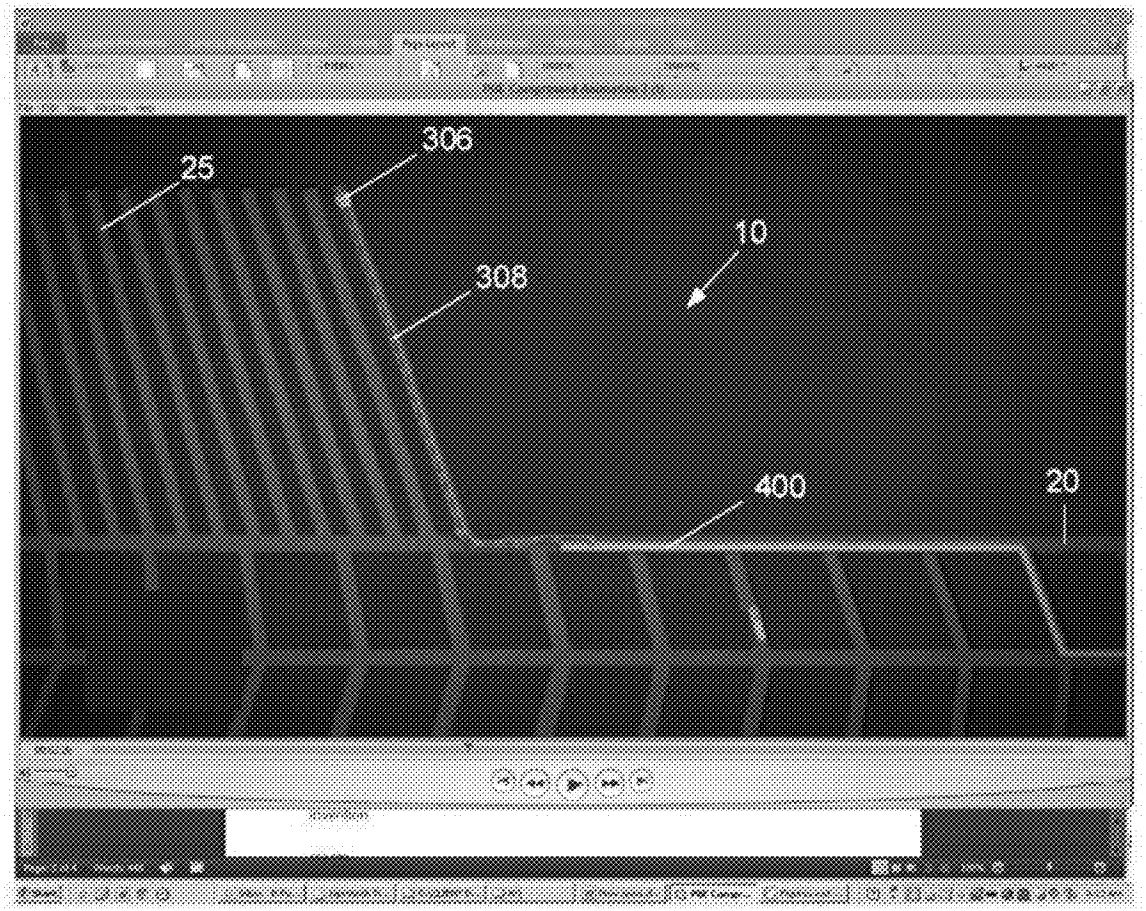
FIG. 4 is a plan sectional view of the system of FIG. 1 showing the continuous miner and flexible conveyor system forming a plunge cut in the mine.

Turning to FIG. 4, the system 300 further includes a static conveyor 400 for conveying material serially received from the flexible conveyor system 308. Accordingly, coal is automatically transferred from the miner 306 to the static belt conveyor 400 via the flexible conveyor system 308 to take the coal ultimately out of the mine. The completed plunge cuts 25 are of a depth to receive the continuous miner 306 and most of the flexible conveyor system 308. The plunge cuts are typically between 30 m and 550 m deep. Accordingly, adjacent sets of gate roads could be up to 800 m or more apart, a substantially greater separation between gate roads than in long wall mining, which further reduces the mining costs.

Figure 5:
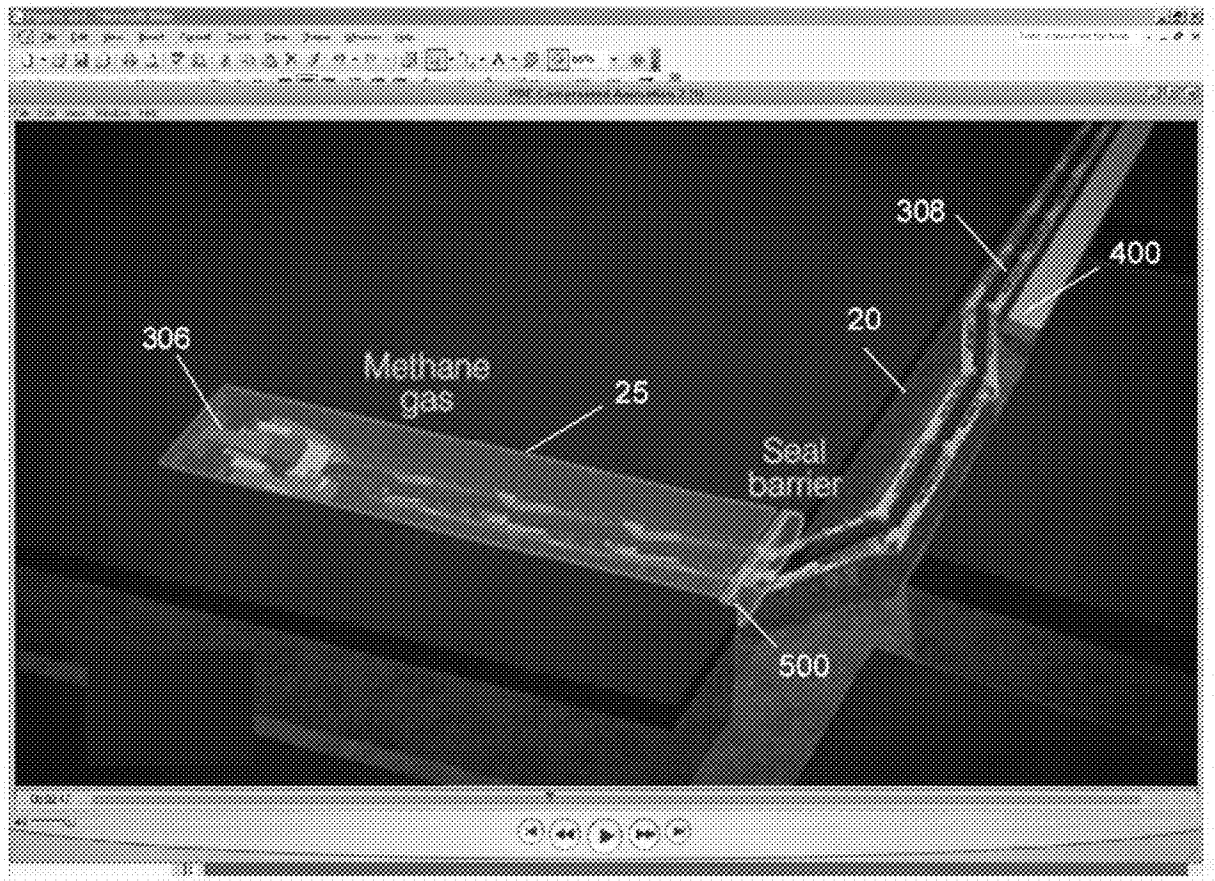
FIG. 5 is a perspective view of the system of FIG. 4 showing a barrier seal at the entry of a plunge cut.
Figure 6:
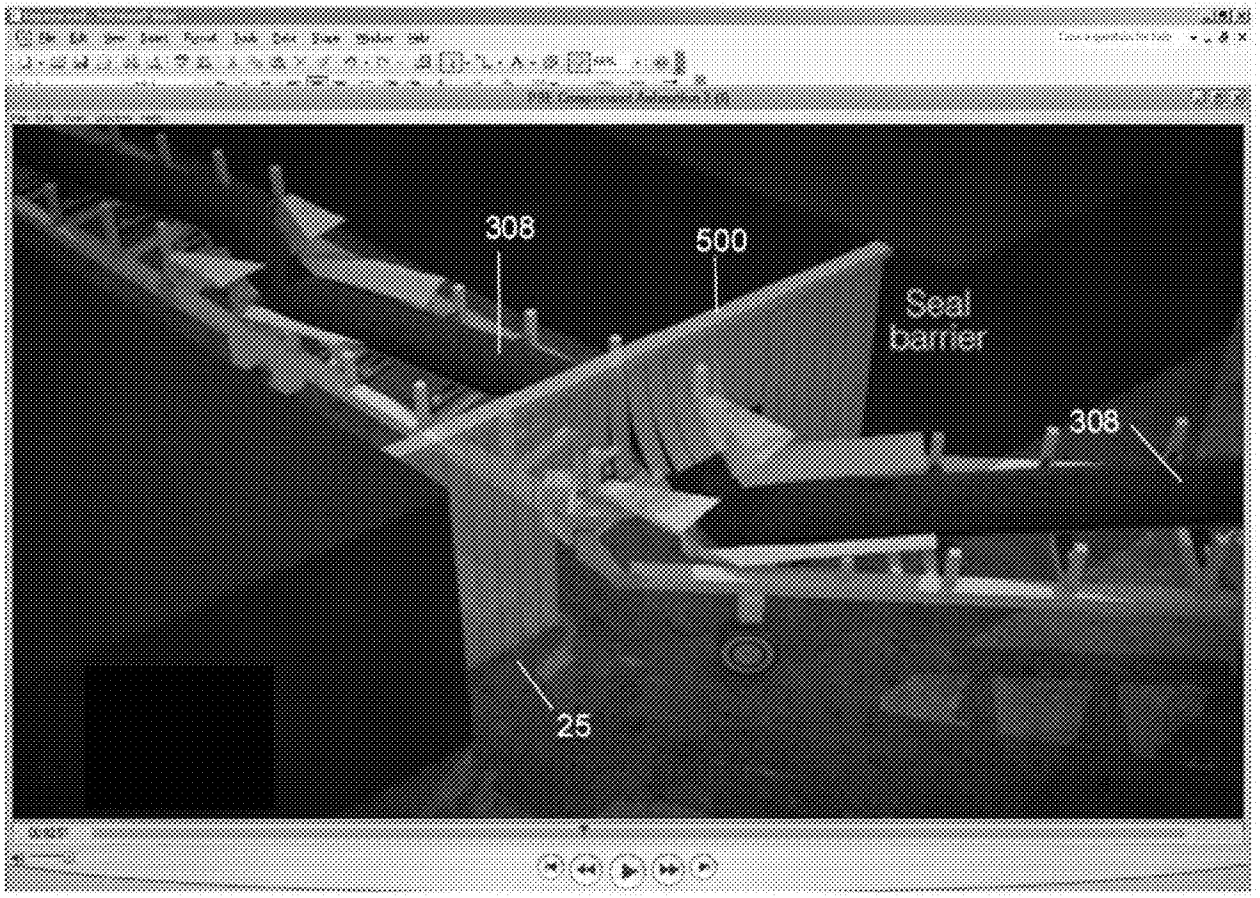
FIG. 6 shows a close up of the barrier seal of FIG. 5.

As shown in FIG. 5, the system 300 includes a barrier seal 500 for blocking and at least partially sealing each dead end plunge cut 25 during its formation. As can best be seen in FIG. 6, the seal includes a horizontal bar from which compliant strips hang, and is mounted in the mouth of the plunge cut 35. In use, the flexible conveyor system 308 can freely pass through the barrier seal 500.

Figure 7:
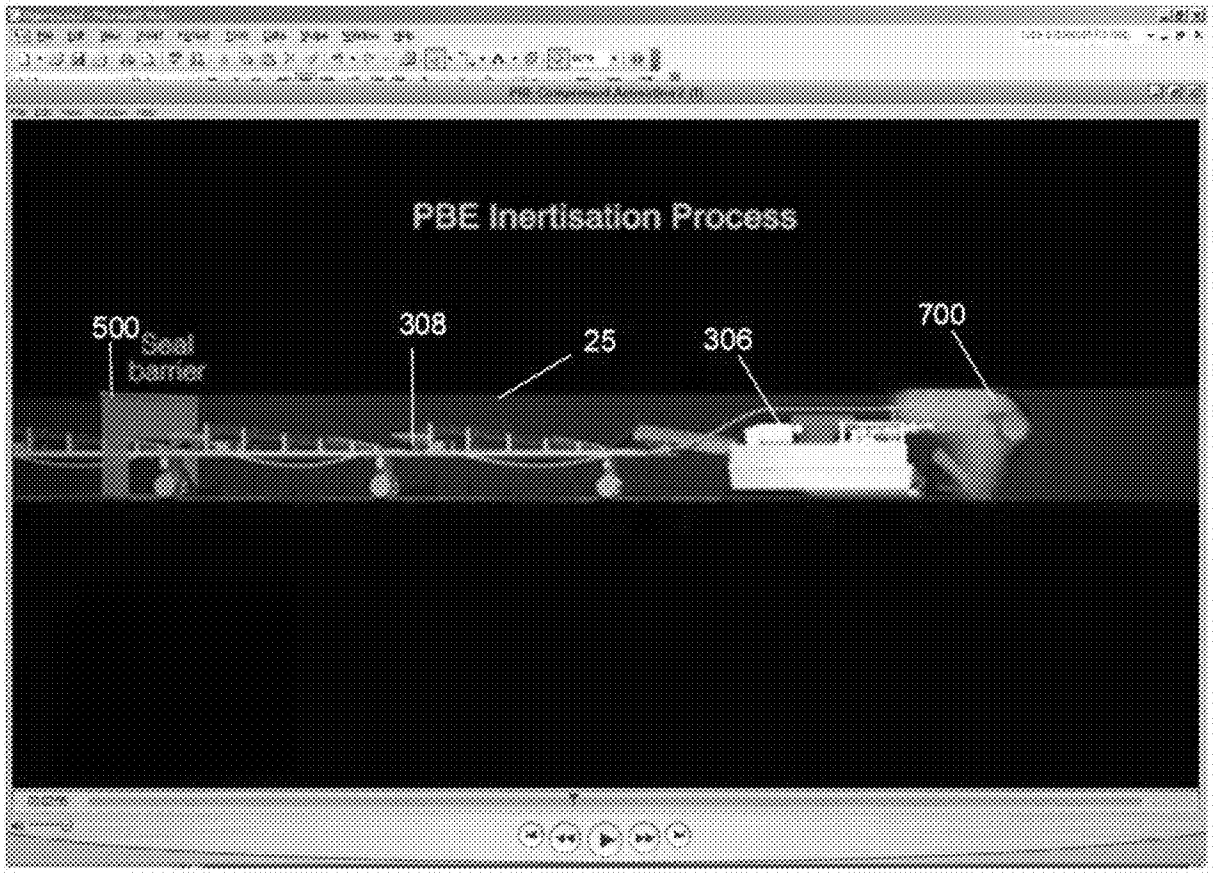
FIG. 7 is a side sectional view of the system of FIG. 5 showing inert gas provided at the cutting face.

Turning to FIG. 7, the continuous miner 306 includes an inert gas supply for supplying inert gas 700 (e.g. carbon dioxide or nitrogen) to the cutting face of each plunge cut 25 to avoid hazards such as frictional ignition, methane ignition as it is emitted from the coal or coal dust ignition in extreme events, in the plunge cut 25. The system 300 further includes sensors for sensing characteristics of the working environment in the sealed plunge cut 25 during its formation. The sensed characteristics include the gas or oxygen content along the plunge cut 25, ventilation, strata movement and dust levels in the plunge cut 25. The continuous miner 30 is unmanned, and there is no risk to any operator in the unlikely event of a collapse in the plunge cut 25.

The continuous miner 306 also includes an inertial navigation system for navigating during formation of the plunge cuts 25. The inertial navigation system includes sensors for sensing characteristics including angle (e.g. horizon control) or positioning (e.g. heading). The continuous miner 306 also includes a gamma detection device for detecting the boundary of the coal seam during excavation.

Figure 8:
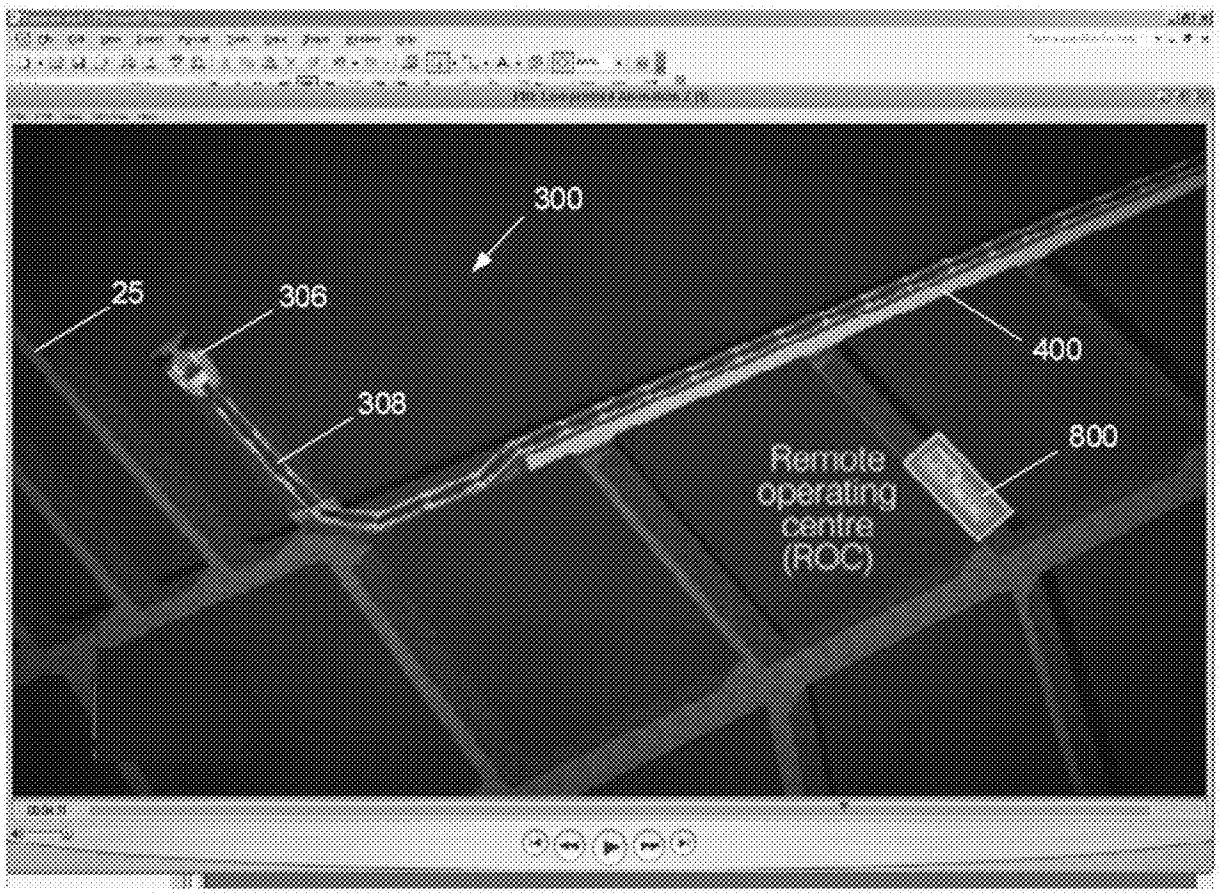
FIG. 8 is a plan sectional view of the system of FIG. 4 showing a remote operations centre (ROC)

Turning to FIG. 8, the system 300 includes an operating centre (ROC) 800 for remotely operating the continuous miner 306 and greater system 300. As no machine operator is present in the cuts 25, the roof of each plunge cut 25 need not be reinforced resulting in reduced costs and time. The ROC 800 is manned and wirelessly communicates with the unmanned continuous miner over the Ethernet. The ROC advantageously limits risks to the operators relating to the mining environment including noise exposure, equipment risks, dust exposure and roof collapse.

Figure 9:
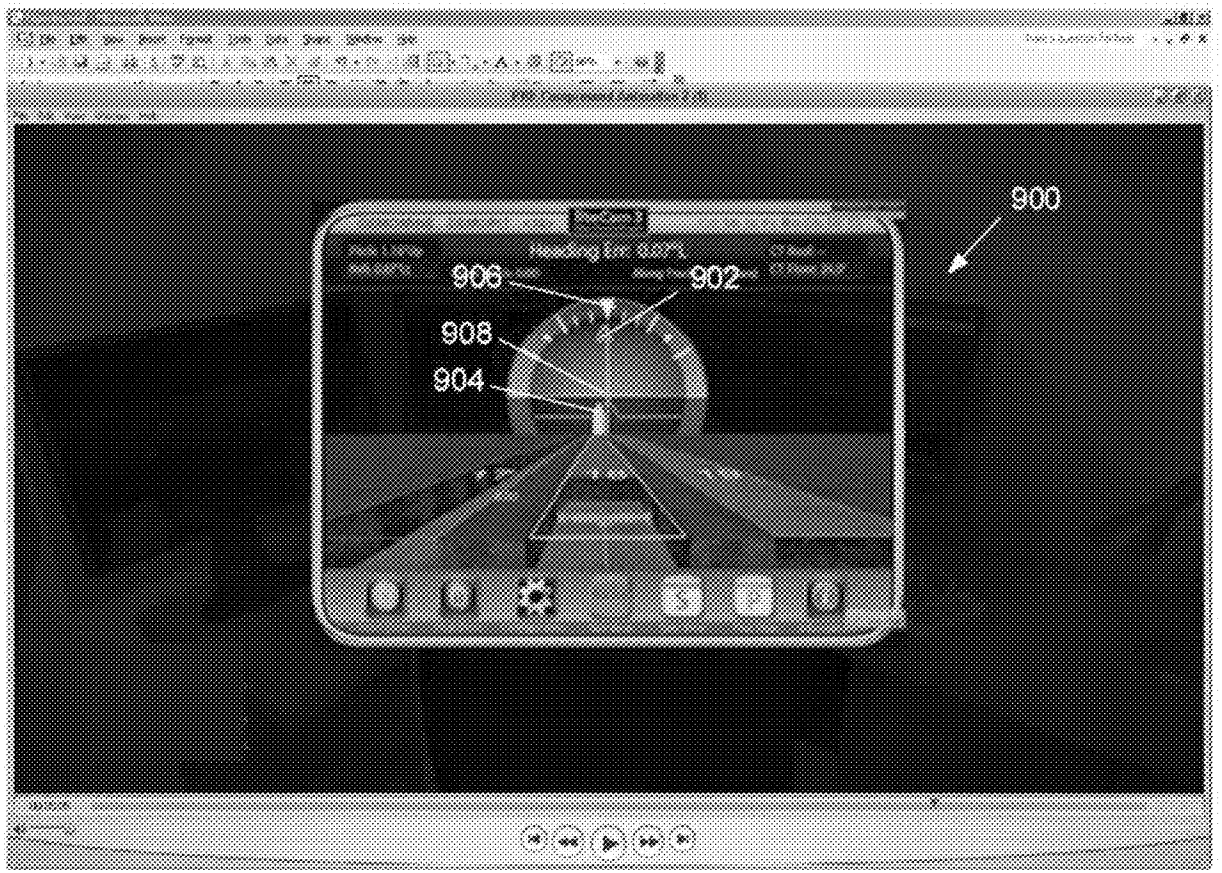
FIG. 9 shows an exemplary computer display screen presented to an operator in the ROC of FIG. 8.

FIG. 9 shows an exemplary computer display screen 900 presented to an operator in the ROC 800. The operator remotely monitors the working environment in the sealed plunge cut 25 during its formation. The monitoring involves monitoring miner characteristics of the continuous miner 306. The miner characteristics include actual angle (e.g. horizon control) 902 and heading (e.g. positioning) 904 which are superposed with computer calculated desired angle 906 and heading 908. The operator controls the miner 306 remotely by aligning the actual angle 902 with desired angle 906, and actual heading 904 with desired heading 908 based upon the desired layout of the mine 10. The monitoring also involves monitoring the gas, ventilation, strata movement or dust levels in the plunge cut 25 using sensors in the plunge cut 25 and the gamma detector of the miner 306.

Returning to FIG. 1, a method for forming the mine 10 is briefly described. Note that the underground mine may be developed either from an open cut excavation or from the ground surface of the mine via a set of tunnels angled downwards at a compliant slope to intersect the underground coal seam.

Initially, the main headings 1 and then gate roads are formed using a continuous miner 306.

Next, the continuous miner 306 is coupled to tow the flexible conveyor system 308. The miner 306 and system 308 then sequentially form the plunge cuts 25 firstly along the left gate road 17 and then the right gate road 20 of a given gate road set 15. First, the miner 306 extends forwards and creates a plunge cut 25, before reversing out of the plunge cut 25 and back into a retracted position, ready to form the adjacent plunge cut 25. With reference to FIG. 4, the flexible conveyor system 308 substantially enters each plunge cut 25 during its formation. The length of the flexible conveyor system 308 can be varied by changing the number of constituent conveyors 310. In addition, the normally static conveyor 400 can also be expanded or moved as required.

A person skilled in the art will appreciate that many embodiments and variations can be made without departing from the ambit of the present invention.

For example, the plunge cuts 25 can be formed at any angle of about 20 to 170 degrees to the straight coal face 23 lining the gate roads 17, 20.

In one embodiment, multiple continuous miners 306 can simultaneously form plunge cuts 25 in respective coal blocks.

In one embodiment, the flexible conveyor system 308 can be replaced by another type of continuous haulage system positioned between the continuous miner 306 and the fixed conveyor 400. For example, a variable length continuous haulage conveyor system (e.g., Flexiveyor, Prairie Machine & Parts, Saskatoon, SK, Canada), or other haulage machine/system which hauls the coal to the conveyor can be used.

In one embodiment, the plunge cuts 25 may be alternately formed on either side of a gate road set 15, rather than one side and then the other.

In one embodiment, potash may be the valuable material mined, rather than coal.

In one embodiment suitable fill material (such as a cementitous type fill or similar variant, with properties such that the fill "sets" to form a moderately strong homogenous material) may be provided into the mined out plunge cuts 25 and allowed to set. In turn, the intervening pillars 30 can then be mined using the continuous miner 306 and the flexible conveyor system 308, whilst the set fill supports the adjacent roof strata.

In compliance with the statute, the invention has been described in language more or less specific to structural or methodical features. It is to be understood that the invention is not limited to specific features shown or described since the means herein described comprises preferred forms of putting the invention into effect.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The claims defining the invention are as follows:

1. An underground mining method including the steps of forming:

forming one or more sets of underground gate roads, each set of gate roads including at least two headings; and forming underground dead-end plunge cuts extending from the sets of gate roads, each plunge cut formed with an unmanned continuous miner coupled to a flexible conveyor system and being greater than 30 meters in length with a roof that need not be supported;

sealing each dead-end plunge cut to form a ventilation barrier whilst still permitting entry of the continuous miner coupled to a flexible conveyor system; and supplying inert gas to a cutting face of each plunge cut.

2. A mining method as claimed in claim 1, involving transporting mined material from the continuous miner using unmanned transport equipment beneath the roof.

3. A mining method as claimed in claim 1, involving forming a main entry tunnel from which the sets of gate roads later extend.

4. A mining method as claimed in claim 1, involving extracting valuable material from the plunge cuts extending into one or more blocks of valuable material between adjacent sets of gate roads.

5. A mining method as claimed in claim 1, involving forming a supporting pillar between plunge cuts extending from adjacent sets of gate roads.

6. A mining method as claimed in claim 1 In which each plunge cut is in a working environment and involving remote monitoring of the working environment in each plunge cut during its formation.

7. A mining method as claimed in claim 1, involving forming the plunge cuts on one side of a set of gate roads prior to forming plunge cuts on another side of the set of gate roads.

8. A mining method as claimed in claim 1, involving introducing a suitable settable fill material into the mined out plunge cuts.

9. A mining method as claimed in claim 1, wherein the step of sealing is performed with a seal through which the continuous miner coupled to a flexible conveyor system passes.

10. A mining method as claimed in claim 9, wherein the seal includes compliant strips hanging at the mouth of the plunge cut.

11. An underground mine including:

one or more sets of underground gate roads, each set of gate roads including at least two headings; and underground dead-end plunge cuts extending from the sets of gate roads, each plunge cut formed with an unmanned continuous miner coupled to a flexible conveyor system and being greater than 30 meters in length with a roof that need not be supported;

sealing each dead-end plunge cut to form a ventilation barrier whilst still permitting entry of the continuous miner coupled to a flexible conveyor system; and supplying inert gas to a cutting face of each plunge cut.

12. A mine as claimed in claim 11, wherein each plunge cut is formed by transporting mined material from the continuous miner using unmanned transport equipment beneath the roof.

13. A mine as claimed in claim 12, wherein the unmanned transport equipment includes a flexible conveyor system coupled to the continuous miner or an unmanned shuttle car for shuttling mined material from the continuous miner.

14. A mine as claimed in claim 11 wherein, in each set of gate roads, one of the at least two headings can supply air whereas another of the at least two headings can return air.

15. A mine as claimed in claim 11, wherein each set of gate roads further includes one or more cut-through tunnels extending between adjacent headings providing inter connectivity between adjacent headings.

16. A mine as claimed in claim 11, further including a set of main entry tunnels from which the sets of gate roads extend.

17. A mine as claimed in claim 11, further including blocks of valuable material between adjacent sets of gate roads and into which the plunge cuts are formed.

18. A mine as claimed in claim 11, further including a supporting pillar between plunge cuts extending from adjacent sets of gate roads.

19. A mine as claimed in claim 11, wherein the plunge cuts are parallel and extend obliquely from the sets of gate roads.

20. An underground mining system including:

(1) an underground mine including:

one or more sets of underground gate roads, each set of gate roads including at least two headings; and underground dead-end plunge cuts extending from the sets of gate roads, each plunge cut having a generally quadrilateral cross section and being greater than 30 meters in length with a roof that need not be supported; and (2) an unmanned continuous miner coupled to a flexible conveyor system for forming the plunge cuts, each dead-end plunge cut being sealed to form a ventilation barrier whilst still permitting entry of the continuous miner coupled to a flexible conveyor system, and inert gas being supplied to a cutting face of each plunge cut.

* * * * *